US008170450B2

(12) United States Patent
Aoki

(10) Patent No.: US 8,170,450 B2
(45) Date of Patent: May 1, 2012

(54) COLOR ELECTROPHOTOGRAPHIC IMAGE FORMING APPARATUS THAT UTILIZES A ROTATABLE ROTARY SUPPORT MEMBER TO SUPPORT A PLURALITY OF DEVELOPING DEVICES

(75) Inventor: Daisuke Aoki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/841,844

(22) Filed: Jul. 22, 2010

(65) Prior Publication Data

US 2011/0013941 A1 Jan. 20, 2011

Related U.S. Application Data

(63) Continuation of application No. PCT/JP2009/061736, filed on Jun. 26, 2009.

(51) Int. Cl.
*G03G 15/01* (2006.01)

(52) U.S. Cl. ..... 399/227

(58) Field of Classification Search ..... 399/223, 399/227

See application file for complete search history.

(56) References Cited

U.S. PATENT DOCUMENTS

| | | | | |
|---|---|---|---|---|
| 5,655,190 | A | 8/1997 | Fuchiwaki | |
| 7,664,436 | B2 | 2/2010 | Aoki | |
| 7,689,135 | B2 * | 3/2010 | Tanaka | 399/227 |

FOREIGN PATENT DOCUMENTS

| | | | |
|---|---|---|---|
| JP | 8-328347 | A | 12/1996 |
| JP | 2003-228211 | A | 8/2003 |
| JP | 2006-126337 | A | 5/2006 |
| JP | 2008-310304 | A | 12/2008 |

* cited by examiner

*Primary Examiner* — William J Royer
(74) *Attorney, Agent, or Firm* — Canon USA, Inc., I.P. Division

(57) ABSTRACT

A color electrophotographic image forming apparatus to form an image on a recording medium may include a photosensitive member, a rotary support member, a first member, a second member, and a controlling unit. The photosensitive member forms an electrostatic latent image. The rotary support member moves a developing device to a developing position to develop the electrostatic latent image by rotation. The first member rotates multiple times of a natural number when the rotary support member rotates once and moves together with the rotary support member. The second member moves together with the rotary support member. A first sensor detects a rotation of the first member and a second sensor detects the rotary support member as positioned at a predetermined phase. The controlling unit detects a phase of the rotary support member by a first signal from the first sensor and a second signal from the second sensor.

30 Claims, 10 Drawing Sheets

(a)

(b)

(a)

(b)

COLOR ELECTROPHOTOGRAPHIC IMAGE FORMING APPARATUS THAT UTILIZES A ROTATABLE ROTARY SUPPORT MEMBER TO SUPPORT A PLURALITY OF DEVELOPING DEVICES

CROSS REFERENCE TO RELATED APPLICATIONS

This application is a Continuation of International Application No. PCT/JP2009/061736, filed Jun. 26, 2009, which is hereby incorporated by reference herein in its entirety.

BACKGROUND OF THE INVENTION

1. Field of the Invention

The present invention relates to a color electrophotographic image forming apparatus that utilizes a rotatable rotary support member to support a plurality of developing devices.

2. Description of the Related Art

Conventionally, a color electrophotographic image forming apparatus using a rotatable rotary support member (rotary) supporting a plurality of developing devices has been known in the art. Rotating the rotary support member in the color electrophotographic image forming apparatus sequentially moves a plurality of developing devices supported by the rotary support member to a developing position that is opposed to an photosensitive drum. The color electrophotographic image forming apparatus includes a sensor flag that is positioned relative to the rotary support member to detect a self-phase of the rotary support member.

Recent efforts have been towards downsizing a main body of the color electrophotographic image forming apparatus from that in the conventional art. A size of the rotary support member has been decreased in accordance with that downsizing. As a result, the position of the sensor flag has changed to be closer to the center of rotation of the rotary support member compared to the conventional art. This change results in an increase in error. In short, if the main body is downsized, then the detected error of the phase of the rotary support member by the sensor tends to be bigger compared to the conventional art.

For example, if the position of the sensor flag provided on the rotary support member is 50 mm from the center of rotation of the rotary support member, a variation error of a detective precision of the sensor flag is twice as much, compared with the case of 100 mm. This will influence the precision to stop the developing device at the developing position to develop a latent image on the photosensitive drum. Thus, in accordance with the downsizing of the main body of the device, to stop the developing device at the developing position with accuracy compared with a conventional mechanism may be an issue.

SUMMARY OF THE INVENTION

In addressing the above, an embodiment includes a color electrophotographic image forming apparatus to detect phase of the rotary support member, which supports a plurality of developing devices, with accuracy in a small space.

An embodiment also provides a color electrophotographic image forming apparatus that can stop the rotary support member at the developing position with accuracy and implemented downsizing.

According to an aspect of the present invention, a color electrophotographic image forming apparatus for forming an image on a recording medium includes: a photosensitive member forming an electrostatic latent image; a rotary support member configured to support a plurality of developing devices for developing the electrostatic latent image, and to move a developing device to a developing position for developing the electrostatic latent image by rotation; a first member configured to rotate multiple times of a natural number when the rotary support member rotates once moving together with the rotary support member, a rotation of the first member being detected by a first sensor; a second member configured to move together with the rotary support member, the rotary support member being detected to be positioned at a predetermined phase by a second sensor; and a controlling unit configured to detect a phase of the rotary support member by a first signal to be output from the first sensor having detected the first member, and a second signal to be output from the second sensor having detected the second member.

DESCRIPTION OF THE EMBODIMENT

First Embodiment

[Color Electrophotographic Image Forming Apparatus]

Figure 1:
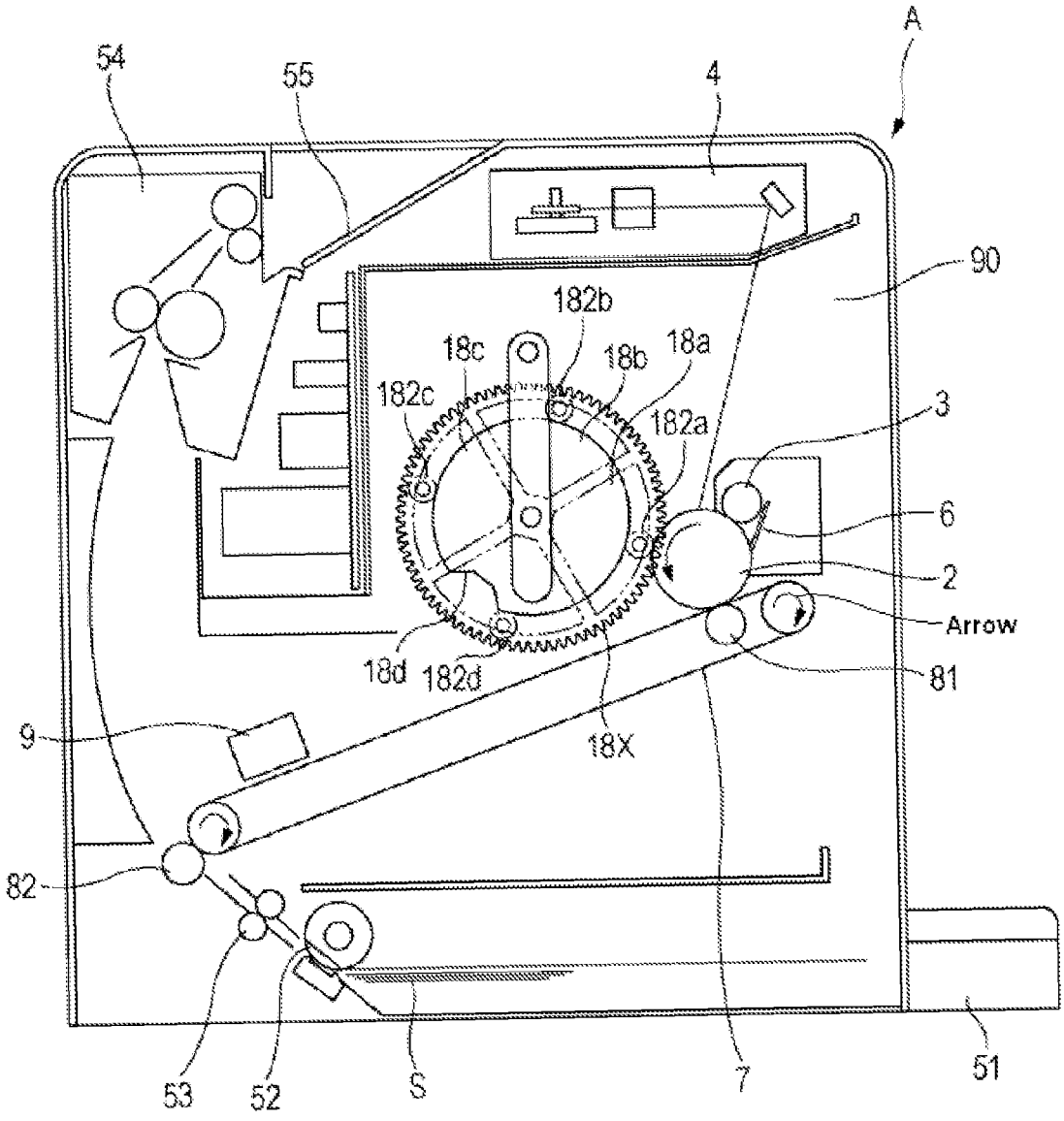
FIG. 1 is a sectional view showing the outline configuration of a laser beam printer, which is an example of an image forming apparatus.

A color electrophotographic image forming apparatus concerning Example 1 will be described. Herein, as a color electrophotographic image forming apparatus, a color laser beam printer comprising four developing devices is exemplified. FIG. 1 is a sectional view of the color laser beam printer.

First, an image forming operation of this color laser beam printer will be described.

As shown in FIG. 1, an image forming apparatus A comprises an electrophotographic photosensitive drum (explained as photosensitive drum below) 2. Located around the photosensitive drum 2 are a charging roller 3, an exposure device 4, four developing devices 18*a*-18*d*, and a cleaning device 6. Charging roller 3 is for charging the photosensitive drum 2 equally. Exposure device 4 irradiates the photosensitive drum. 2 with a laser beam, depending on image information. After the charging roller 3 applies an electrostatic charge on the photosensitive drum 2, the exposure device 4 irradiates the photosensitive drum 2 with a laser beam to form an electrostatic latent image on the photosensitive drum 2. The four developing devices 18*a*-18*d* develop and visualize the latent image formed on the photosensitive drum 2 using a developer of a corresponding color. Developing device 18*a* accommodates a yellow developer, where developing device 18*a* is a yellow developing device for developing the electrostatic latent image with the yellow developer. Developing device 18*b* accommodates a magenta developer, where developing device 18*b* is a magenta developing device for developing the electrostatic latent image with the magenta developer. Developing device 18*c* accommodates a cyan developer, where developing device 18*c* is a cyan developing device for developing the electrophotographic latent image with the cyan developer. Moreover, developing device 18*d* accommodates a black developer, where developing device 18*d* is a black developing device for developing the electrostatic latent image with the black developer. Here, developing devices 18*a*-18*d* develop electrostatic latent images formed on the photosensitive drum 2.

The cleaning device 6 works to remove developer remaining behind on the surface of the photosensitive drum 2.

A process for discharging a sheet S, having a transferred color image, to a discharging portion of an upper cover 55 located outside of a main body of a device 90 is as follows. In an example, main body of a device 90 may be viewed as a device main body 90, where the device may be image forming apparatus A. First, photosensitive drum 2 is synchronized with the rotation of an intermediate transfer belt 7, and is rotated in the direction of the arrow (counterclockwise direction) in FIG. 1. A front surface of the photosensitive drum 2 is uniformly charged by charging roller 3. Further, in addition to the charging roller 3, the light irradiation of a yellow image is carried out by exposure device 4, and an electrostatic latent image of yellow is formed on photosensitive drum 2.

Figure 2:
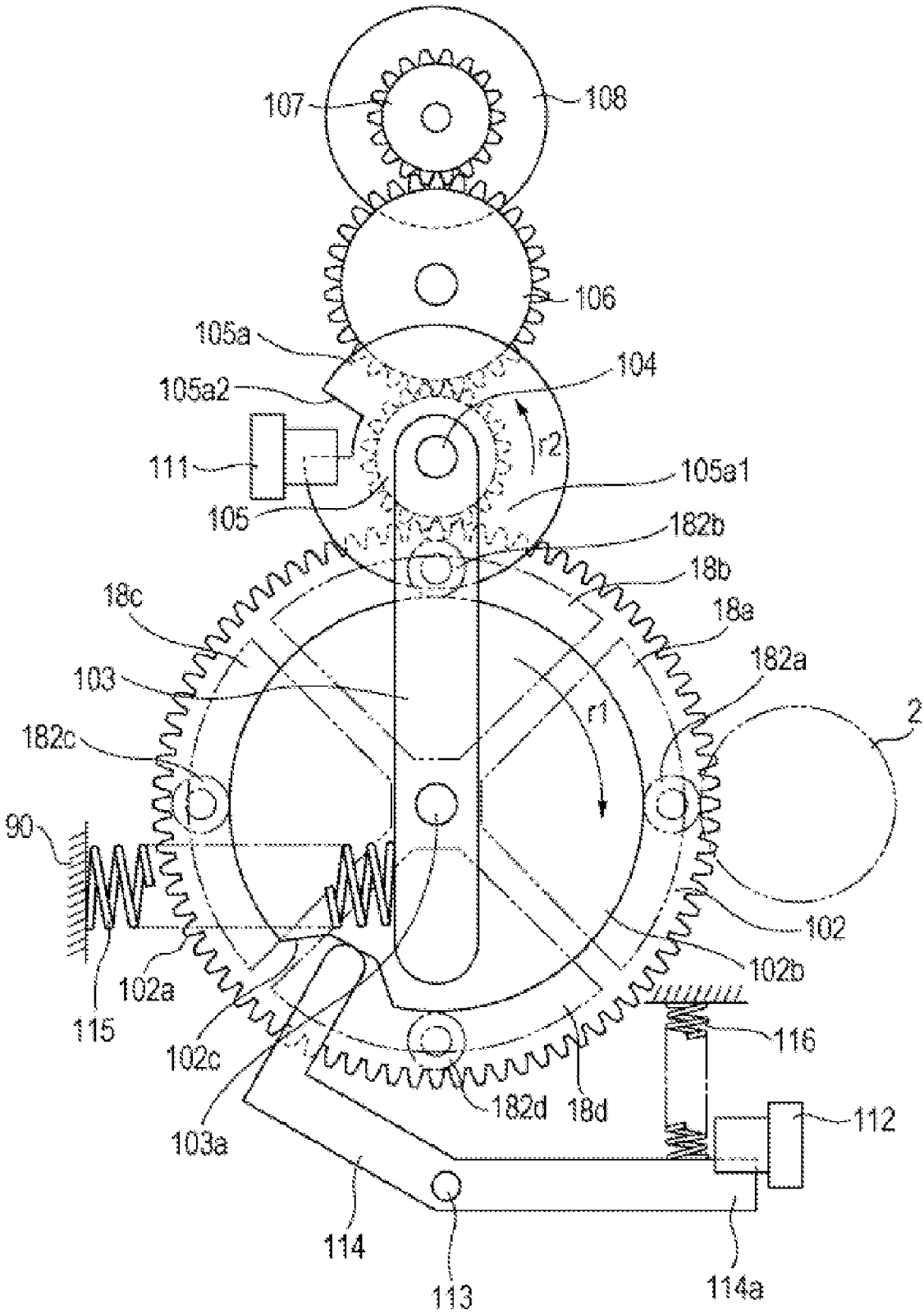
FIG. 2 is an elevation view showing a phase detective configuration of a rotary concerning a first embodiment.
Figure 7:
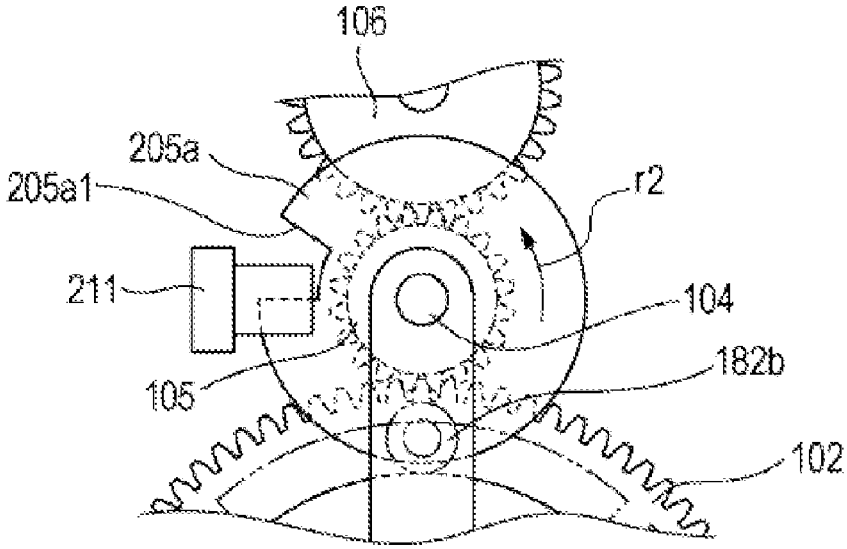
FIGS. 7A and 7B is a detail view showing a variation concerning the first embodiment.
Figure 7:
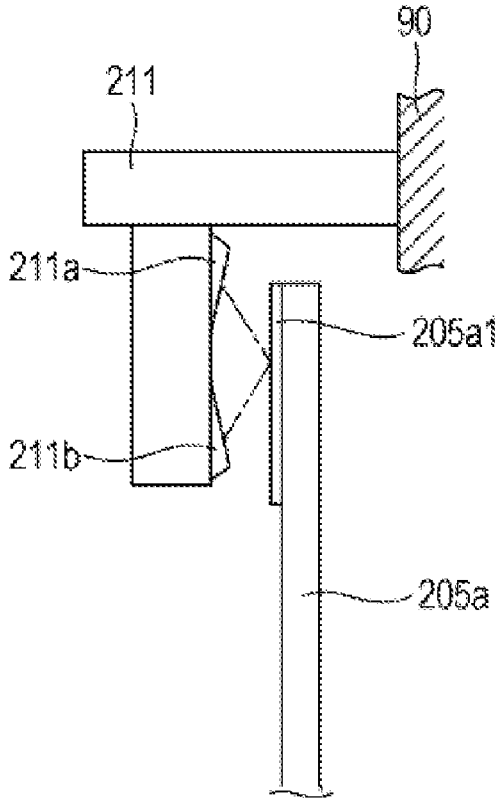

With the formation of this yellow electrostatic latent image, the four developing devices 18*a*-18*d* are detachably supported. A rotary 102 (FIG. 7), which is a rotatable rotary support member, is rotated by a drive transmission mechanism described below. The yellow developing device 18*a* is stopped at the developing position 18X opposed to the photosensitive drum 2. At the developing position 18X, a developing roller 182*a*, which is included in the developing device 18*a*, comes in contact with the photosensitive drum 2. And a voltage, of which the polarity is the same as that of the charged photosensitive drum 2 and of which the potential is substantially the same as that of the charged photosensitive drum 2, is applied to the developing roller 182*a* so that a yellow developer is adhered to the electrostatic latent image on the photosensitive drum 2. As a result an eletrostatic latent image is developed in yellow developer. That is, rotary 102 moves a plurality of developing devices 18*a*-18*d* one by one to the developing position 18X, which is opposed to the photosensitive drum 2, by supporting the developing devices 18*a*-18*d* and rotating in the arrow direction r1 (FIG. 2). The developing device that is located in developing position 18X develops the electrotatic latent image depending on the color of the accommodated developer within the developing device 18*a*-18*d*. In the present embodiment, each developing roller 182*a*-182*d* is an elastic roller that is rubber coated around its metal axle, where each developing rollers 182*a*-182*d* comes in contact with the photosensitive drum 2 in developing position 18×(contact developing method). Each developing rollers 182*a*-182*d* develops the electrostatic latent image in the state that came in contact with the photosensitive drum 2. However, the embodiments are not limited to this configuration. The embodiments are applicable to configurations where the developing at the latent image is performed with both close but not in contact at the developing position 18X. Even in this configuration, an effect described below can be obtained.

Then, a voltage, of which the polarity is opposite to that of the developer, is applied to a primary transfer roller 81 placed inside of the transfer belt 7. Thereby, the yellow developer image formed on the photosensitive drum 2 is primary transferred to transfer belt 7.

As described above, the primary transfer of the yellow developer image is finished. In addition, each of magenta, cyan, and black color developing devices 18*b*-18*d* is sequentially rotated and moved by rotation of the rotary 102. In addition, each of the magenta, cyan, and black color developing devices 18*b*-18*d* stops at the developing position 18X opposed to the photosensitive drum 2. Moreover, in the same case as yellow, formation, development, and primary transfer are carried out sequentially for each remaining color: magenta, cyan, and black. Four developer images of four different colors are thereby superimposed on the transfer belt 7.

Secondary transfer roller 82 does not contact with transfer belt 7 during the period in which the four-colored developer image is superimposed on the transfer belt 7. In addition, during this period, a cleaning device 9, which removes a residual toner on the transfer belt 7, does not contact transfer belt 7.

Sheet S is a recording medium that is stored in a cassette 51 provided in a lower part of a main body of device 90. It is noted that, the recording medium 5, such as recording sheets and overhead projector (OHP) sheets, forms developer images. The feed roller 52 separately feeds sheet S one by one from cassette 51. In addition, sheet S is fed to a registration roller pair (conveyance roller) 53. The roller pair 53 sends the fed sheet S to a space located between the transfer belt 7 and a secondary transfer roller 82. Here, the secondary transfer roller 82 and the transfer belt 7 are in an urged condition (a state shown in FIG. 1).

A voltage having polarity opposite to the voltage of the developer is applied to secondary transfer roller 82. The four developer images of the different colors superimposed on the transfer belt 7 is transferred (secondary transfer) at one time to the surface of the transported sheet S.

Sheet S, to which the developer image is transferred, is sent to a fixing device 54. In the fixing device 54, sheet S is heated and pressurized to fix the developer image on the sheet S. A color image is thereby formed on the sheet S. Moreover, the sheet S is discharged from the fixing device 54 to a discharging portion of an upper cover 55 located outside of the main body of device 90.

[Drive Transmission Mechanism and Sensor]

Figure 3:
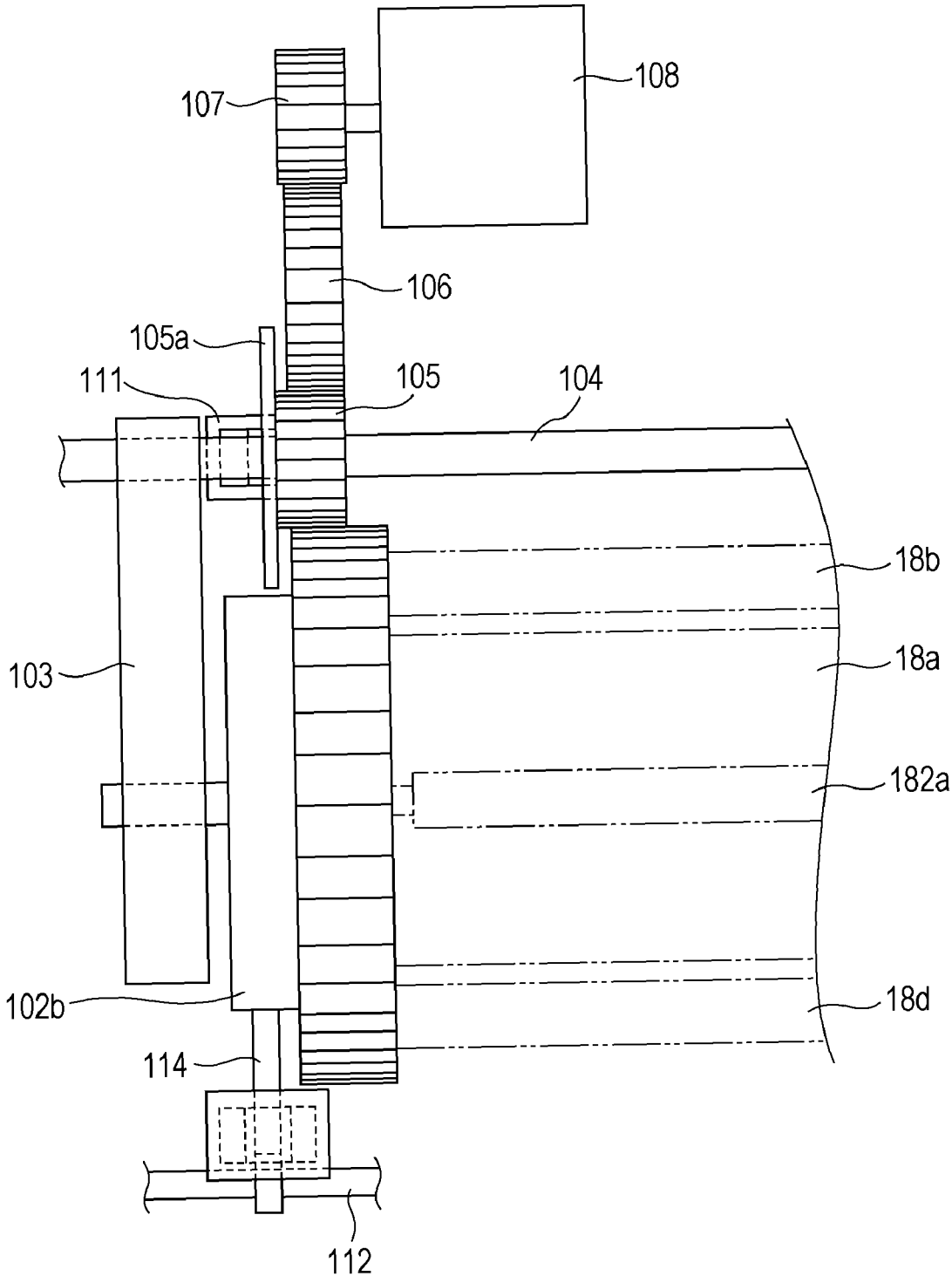
FIG. 3 is aright side elevation view showing the phase detective configuration of the rotary concerning the first embodiment.
Figure 5:
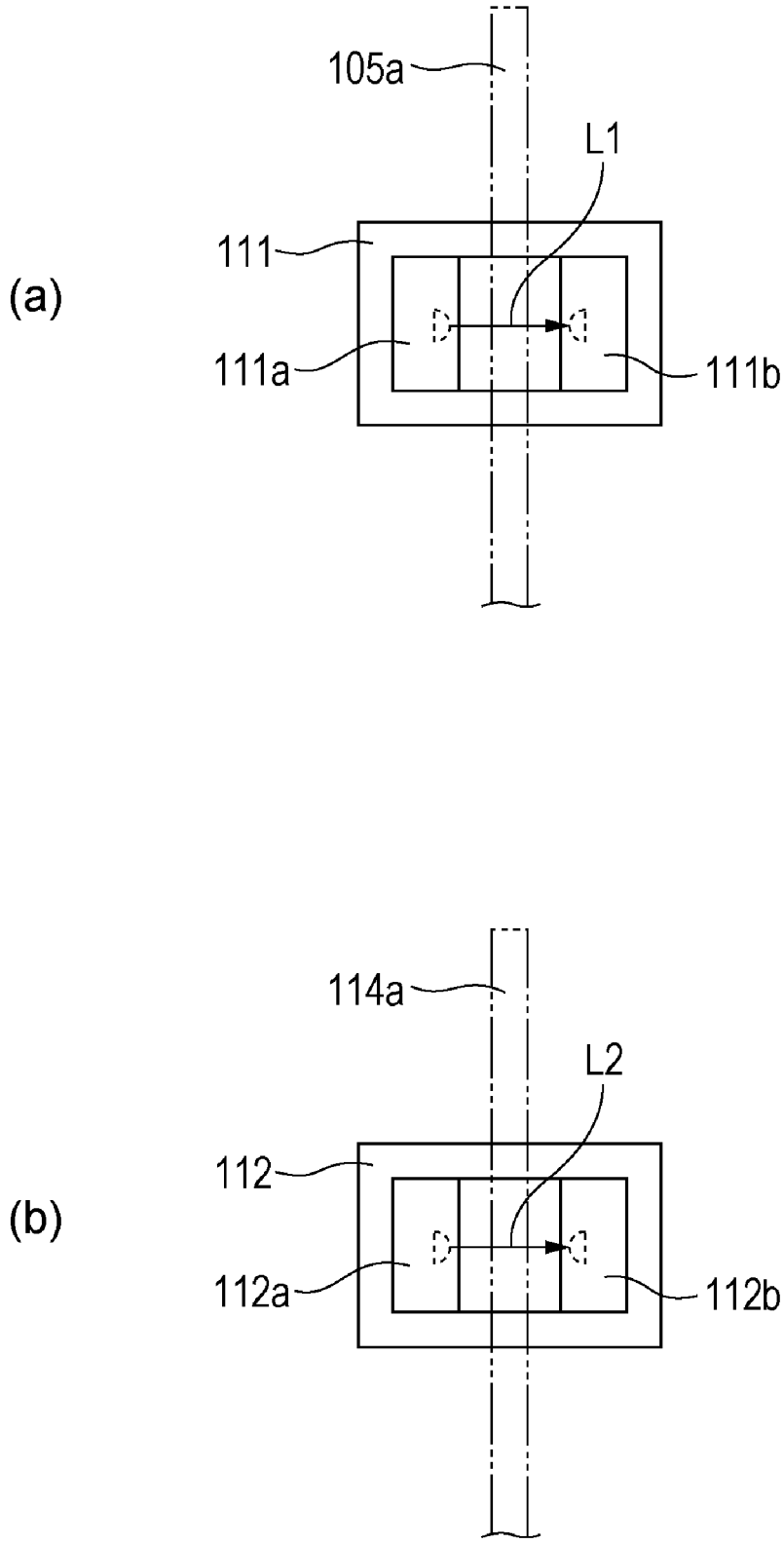
FIGS. 5A and 5B is a detail view concerning the first embodiment.

Described below, using FIGS. 2 and 3, FIGS. 5A and 5B, is a drive transmission mechanism to rotate rotary 102. FIG. 2 is a front view that extracted a part of FIG. 1. FIG. 2 illustrates the conditions where developing roller 182*a* of developing device 18*a* is located at the developing position 18X opposed to the photosensitive drum 2. FIG. 3 is a right side elevation view from the right direction of FIG. 2. It is noted that developing devices 18*a*-18*d* and developing rollers 182*a*-182*d* are shown in two-dot chain line. FIGS. 5A and 5B is a detailed view of a sensor.

Arm 103 is swingably supported mainly by the drive shaft 104 rotatably supported by the main body of device 90 rotatably. Arm 103 supports rotary 102 to be rotatable by rotation center 103*a*.

One end of arm spring 115, which is a compression spring, is fixed to the main body of device 90. In addition, the other end of arm spring 115 is abutted to arm 103. Arm spring 115 produces power to push developing device 18*a* supported by rotary 102 in an appropriate pressure to the photosensitive drum 2. Idler gear 105 rotates mainly around drive shaft 104 in the arrow r2 direction.

Idler gear 105 has plate 105*a*, which is a first member to be detected by a first sensor 111, which is the first detective sensor installed in the main body of device 90. Here, plate 105*a* is a flange integrally molded with idler gear 105. First sensor 111 is an optical sensor which comprises light projecting unit 111*a* (FIG. 5A) for projecting detective light shown in FIG. 5A and light receiving unit 111*b* receiving the detective light generated by light projecting unit 111*a*. Plate 105*a* comes in between the light projecting unit 111*a* and light receiving unit 111*b*. Plate 105*a* comprises shading department 105*a*1, which shades the light from optical path L1 (FIG. 5A) of the detective light, and opening region 105*a*2, which is a notch region that opens optical path L1. Herein, an example of plate 105*a* comprised integrally by idler gear 105 is described. However, plate 105*a* may be anything rotating with idler gear 105, even if plate 105*a* is independently formed from idler gear 105.

Idler gear 105 engages with gear part 102*a*, which is provided outside rotary 102. Idler gear 105 transmits rotary power of stepper motor 108 (FIGS. 2 and 3) to rotary 102. Here, the number of the teeth of gear part 102*a* is defined 4 times larger than idler gear 105. In other words, when idler gear 105 rotates one lap, rotary 102 makes a quarter rotation in the arrow r1 (FIG. 1) direction. Moreover, rotary 102 rotates one lap in the arrow r1 direction if idler gear 105 rotates four laps.

Stepper motor 108 can rotate rotary 102 through pinion gear 107, idler gear 106, and idler gear 105. Here, a stepper motor is used. However, an effect described below can be obtained even in the case where DC motors comprising a pulse encoder that can control rotary phase is used and an electromagnetic clutch or the like which can intercept driving force is provided.

Detective arm 114, which is the second member to be detected, is rotatably supported by rotation fulcrum 113 installed in the main body of device 90. Detective arm 114 receives pressing force by spring 116, which is a compression spring. In addition, detective arm 114 is abutted to cam part 102*b* provided in rotary 102. Moreover, one end of detective arm 114 is detected by a second sensor 112, which is the second detective sensor installed in the main body of device 90. As is the same with the first sensor 111, the second sensor 112 comprises integrally light generating unit 112*a* projecting detective light shown in FIG. 5B and light receiving unit 112*b* receiving detective light generated from light generating unit 112*a*. Detective arm 114 is inserted between projection of the light generating unit 112*a* and light receiving unit 112*b*. One end of detective arm 114 has shading part 114*a*, which can shade the light in optical path L2 of the detective light.

[Control Unit]

The main body of device 90 includes a central processing unit (CPU) 83. CPU 83 is a control unit for controlling the rotation of motor 108 based on a first signal that is output from the first sensor 111 and a second signal that is output from the second sensor 112.

Figure 4:
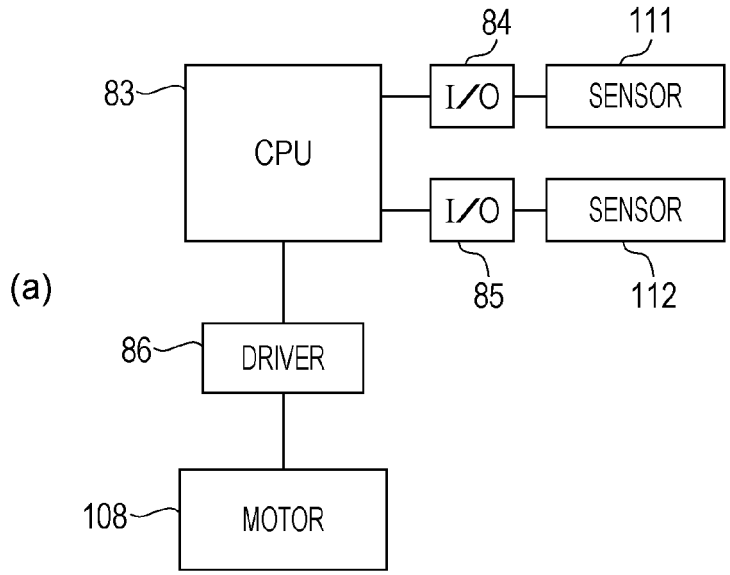
FIGS. 4A and 4B is a chart diagram of a block diagram and a sensor signal concerning the first embodiment.
Figure 4:
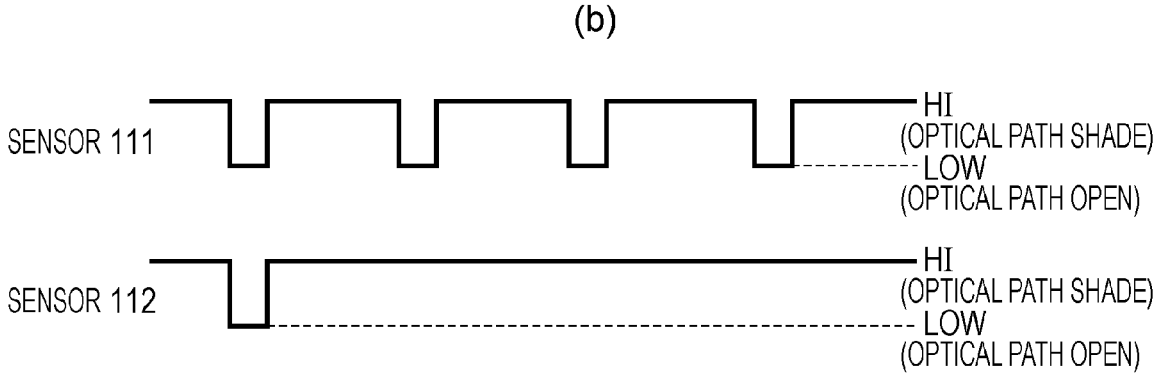

As shown in FIG. 4A, CPU 83 is electrically connected with the first sensor 111 through an input/output (I/O) circuit 84, performs control so that the light projecting unit 111*a* emits the detective light, and receives a signal generated based on the detective light received in the light receiving unit 111*b*. As shown in FIG. 4B, the voltage value becomes a high (HI) state (e.g., 5V) when the first sensor 111 detects that the optical path L1 is shaded. The voltage value is set to be in a low (LOW) state (e.g., 0V) in I/O circuit 84 when the first sensor 111 detects that the optical path L1 is open. The CPU 83 is electrically connected with the motor 108 through a driver 86. In addition to controlling the detective light, the CPU 83 controls the rotation of motor 108.

In this embodiment, idler gear 105 is engaged with gear part 102*a* such that the developing roller 182*a* of yellow developing device 18*a* abuts the photosensitive drum 2 in a moment when the first sensor 111 detects the opening region 105*a*2 provided in plate 105*a*. As described earlier, the number of the teeth of gear part 102*a* is 4 times of the number of the teeth of idler gear 105. Therefore, the first sensor 111 will detect the opening region 105*a*2 when each developing roller 182*a*-182*d* abuts the photosensitive drum 2 if the developing rollers 18*a*-18*d* are supported in equal distance to the rotary 102. By this, it is recognizable that each developing roller 182*a*-182*d* abuts with the photosensitive drum 2.

However, the CPU 83 cannot recognize what color of developing roller 182*a*-182*d* is abutting. Thus, reentrant 102*c* is provided in cam part 102*b* to detect a predetermined phase of the rotary 102. For example, detective arm 114 is provided in a manner such that it is dropped in the reentrant 102*c* when the developing roller 182*a* comes near the position where it abuts with the photosensitive drum 2 and before first sensor 111 reacts. Even more particularly, the optical path L2 of the second sensor 112 is opened only when the detective arm 114 is dropped in reentrant 102*c*. As for other times, the shading part 114*a* is set to shade out the optical path L2 of the second sensor 112. That is, a role of the second detective, the second sensor 112, is to detect whether rotary 102 is at a predetermined phase position or at a phase position other than the predetermined phase position.

Figure 6:
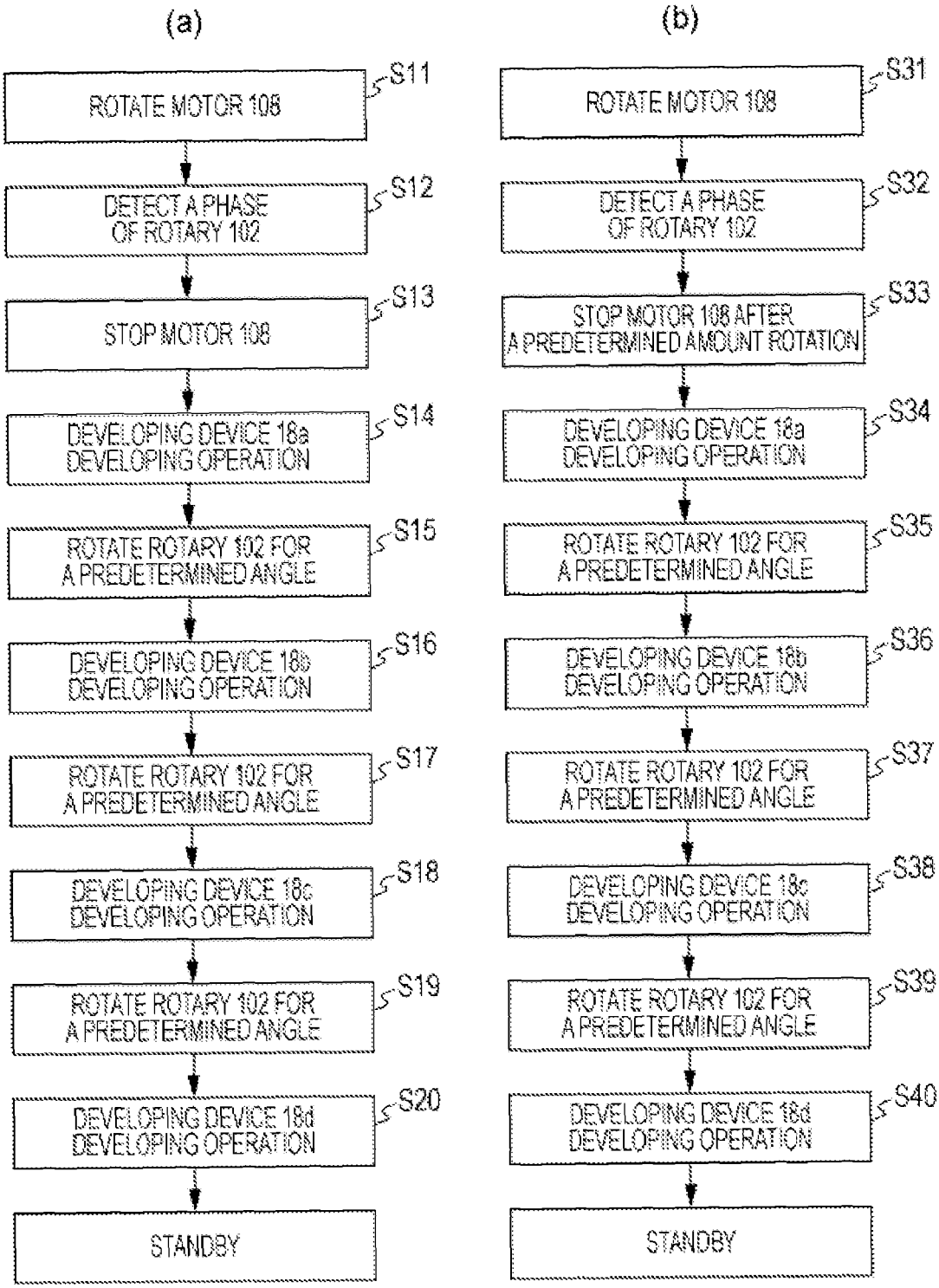
FIGS. 6A and 6B is a flowchart of the control concerning the first embodiment.

The CPU 83 can recognize that yellow developing roller 182*a* abuts photosensitive drum 2 when first sensor 111 opens optical path L1 and the second sensor 112 opens optical path L2 as shown in FIG. 4B. That is, it is recognized that yellow developing roller 182*a* abuts with the photosensitive drum 2 when motor 108 is rotated as shown in the flowchart of FIG. 6A (S11) and when the signal of first sensor 111 and the second sensor 112 are both in a LOW state (S12). The rotary 102 is stopped (S13). Then after a developing operation is performed by developing device 18*a* (S14), the number of the pulses oscillating to the motor 108 is controlled by the driver 86 based on the information about the phase of the rotary 102 (S15). Thereby, each of the other developing devices 18*b*-18*d* is transported to the developing position 18X. It is possible to stop at the developing position 18X (S17, S19). Each developing roller 182*b*-182*d* is abutted to the photosensitive drum 2. The operation (i.e. S16, S18, S20) to develop electrostatic latent image is performed.

Here, as described above, plate 105*a* rotates 4 times when rotary 102 rotates once. Thus, compared to the case of a flag detected by a sensor in the distance of radius "a" of the rotary 102, if the radius of plate 105*a* is "a", the phase of the rotary 102 may be temporarily detected by quarter of error. Also, for instance, compared to the conventional case of a flag detected by a sensor in the distance of radius 2*a* of the rotary 102, if the radius of plate 105*a* is a, the phase of the rotary 102 can be temporarily detected by half of error. That is, the flag to the distance of radius 4*a* in rotary 102 is provided when the detective accuracy that is equal to the detective accuracy of this embodiment is implemented in the system that provided the flag in rotary 102. A big space may be used for the flag to rotate. Mentioning a general relation, when the maximum radius of the rotary 102 is d1, and the radius of plate 105*a* is d2, and when plate 105*a* rotates n times (rotary ratio n), if the relation of $$d2>d1/n$$

is satisfied, accuracy of detection of the rotary 102 can be improved.

Here, temporarily, the maximum radius of the rotary 102 is the distance where the flag detected by a sensor by the rotary 102 can be set from a center of the rotation. The radius of plate 105*a* is the detected member of plate 105*a* detected by the first sensor 111.

Thus, by the configuration of this embodiment, detection can be made with smaller size and with more high dimensional accuracy than the conventional.

In addition, in the present embodiment, the opening region 105*a*2 is detected by the first sensor 111 at the moment when the developing roller 182*a* abuts photosensitive drum 2. However, it can be anywhere. For example, the opening region 105*a*2 is detected by the first sensor 111 at a position 10 degrees before a phase of the rotary 102 when the developing roller 182*a* abuts the photosensitive drum 2. If the reentrant 102*c* is set for detective arm 114 sets to fall into the reentrant 102*c* near the phase of the rotary 102 and also before the first sensor 111 reacts, the CPU 83 can detect the phase of the rotary 102 accurately. A flow chart of this time is shown in FIG. 6B. However, the only thing different from FIG. 6A is step S33, previously described. That is, the CPU 83 may control the motor 108 and rotate the rotary 102, from the detected phase to the phase at which the developing roller 182*a* of the developing device 18*a* abutting with the photosensitive drum 2 (S33). The other control (S31, S32, S34-S40) is the same as the flow chart of FIG. 6A.

The number of the teeth of gear part 102*a* is a multiple of 4 of the teeth of idler gear 105 in the present embodiment. However, the number of the teeth of gear part 102*a* may be a multiple of a natural number n in the present embodiment. For example, if the number of teeth of gear part 102*a* is 10 times larger than that of idler gear 105, the rotary 102 does 1/10 lap when idler gear 105 does 1 lap. In other words, whenever the rotary 102 performs 1/10 lap, the opening region 105*a*2 passes the light to the first sensor 111. In addition, idler gear 105 and gear part 102*a* are set in so that the phase of the rotary 102 is detected with certainty in a moment when the opening region 105*a*2 is detected by the first sensor 111. If detective arm 114 is set to fall into the reentrant 102*c* near the phase of the rotary 102 and also before the first sensor 111 react, the main body of device 90 can detect the phase of the rotary 102 accurately based on the signal output from the first sensor 111 and the signal output from the second sensor 112. Moreover, the number of oscillation pulse to the motor 108 can be controlled. Further, developing rollers 182*a*-182*d* can be moved sequentially and stopped at the developing position 18X. Abutting to the photosensitive drum 2 is possible. However, it is not applicable when the number of the teeth of gear part 102*a* is not a multiple of a natural number n of the number of the teeth of idler gear 105. When it is not a multiple of a natural number n, it is easy to imagine that the phase of the rotary 102 when the opening region 105*a*2 is detected by the first sensor 111 is not constant. The opening region 105*a*2 is detected by the first sensor 111 at the time of the phase of the rotary 102 is a predetermined one only when it is a multiple of a natural number n.

Other Embodiments

In addition, in the present embodiment, the plate 105*a* detected by the first sensor 111 is provided to the idler gear 105, but it may be provided anywhere on the drive line from the driving source driving the rotary 102. However, the condition that the rotary 102 rotates 1/n (in n natural number) when a gear comprising the plate 105*a* or a pulley comprising the plate 105*a* rotates 1 revolution is to be satisfied.

In addition, in the present embodiment, an example showing that the plate 105*a* comprises the shading department 105*a*1 which shades the optical path of the detective light and the opening region 105*a*2 which is a cutout region which opens the optical path L1. However, as shown in FIGS. 7A and 7B, the plate 205*a* may comprise a reflection department 205*a*1 which reflects the detective light. In this case, sensor 211 comprises light department 211*a* of the detective light and light receiving component 211*b* on the same side. Plate 205*a* rotates in the arrow r2 direction. Moreover, the detective light generated by light department 211*a* reflects when the reflection department 205*a*1 comes. In addition, detective light is received in light receiving component 211*b*.

In addition, in the present embodiment, the plate 105*a* which is the first detective member engages with the gear part 102*a* which is provided outside the rotary 102. However, it is not limited to the combination by the gear 102*a* and the gear 105. It may be anything that engages with the rotary 102, such as a friction wheel, belt, and pulley. Thus, phase of the rotary 102 can be controlled with smaller size and with higher dimensional accuracy than the case when the flag is set directly to the rotary 102.

Second Embodiment

Figure 8:
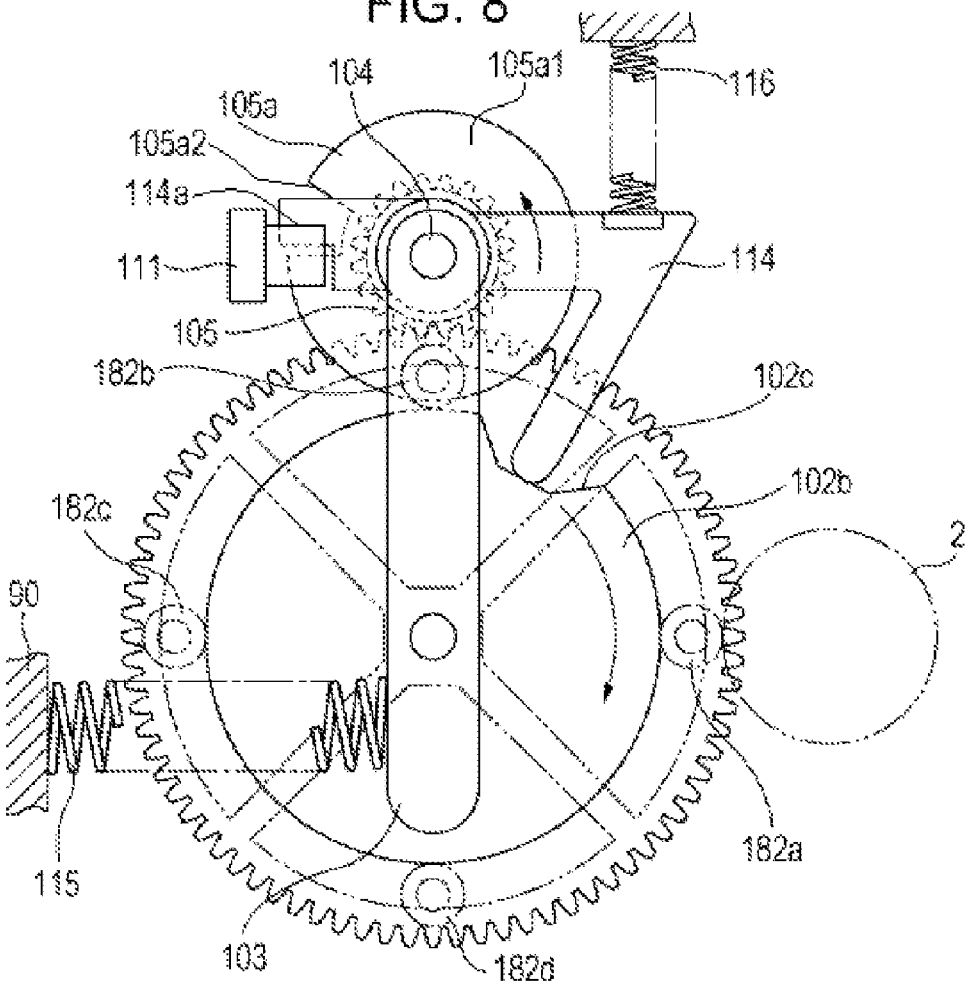
FIG. 8 is a front view showing a phase detective configuration of a rotary concerning a second embodiment.
Figure 9:
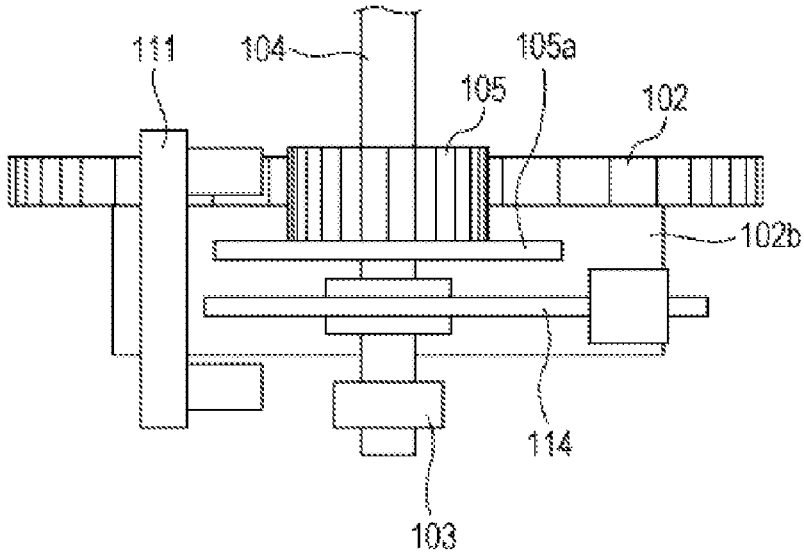
FIG. 9 is aright side elevation view showing the phase detective configuration of the rotary concerning the second embodiment.

FIG. 8 and FIG. 9 illustrate a figure that extracts a rotary part of a color laser beam printer comprising Embodiment 2. FIG. 8 is a front view and FIG. 9 is a top view.

The present embodiment performed detection of the plate 105*a* and detective arm 114 only by the first sensor 111 compared to embodiment 1. Thus, as well as an effect of embodiment 1, there is a benefit that it is possible to omit one sensor.

Idler gear 105 makes a similar operation as embodiment 1. In addition, the number of the teeth of the gear part 102*a* is a multiple of a natural number n of the idler gear 105. Here, it is assumed as 4 times for the convenience of explanation. Plate 105*a* comprises the shading department 105*a*1 shading optical path L1 of detective light as well as embodiment 1 and the opening region 105*a*2 which is a notch unit opening optical light L1. Detective arm 114 is rotatably supported by drive shaft 104. Shading part 114*a* which can shade the light in optical path L1 of the detective light is comprised in one end of detective arm 114. In addition, by being pressed by detective arm 114 which the other end is supported by the main body of device 90, it abuts to cam part 102*b*. In addition, only when detective arm 114 dropped in the reentrant 102*c*, shading part 114*a* opens optical path L1 of the detective light.

Here, as well as embodiment 1, at the moment when the opening region 105*a*2 provided in the plate 105*a* is detected by the first sensor 111, the idler gear 105 and the gear part 102*a* is engaged so that the developing roller 182*a* of yellow the developing device 18*a* abuts to the photosensitive drum 2. Moreover, the reentrant 102*c* is provided for opening optical path L1 when the developing roller 182*a* comes near the position where it abuts the photosensitive drum 2 and also before the first sensor 111 detects the opening region 105*a*2.

Figure 10:
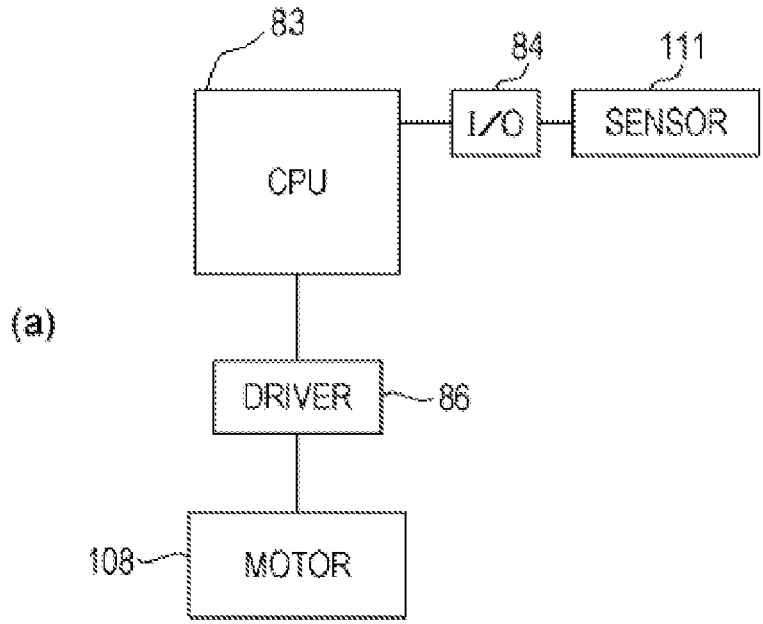
FIGS. 10A and 10B is a chart diagram of a block diagram and a sensor signal concerning the second embodiment.
Figure 10:
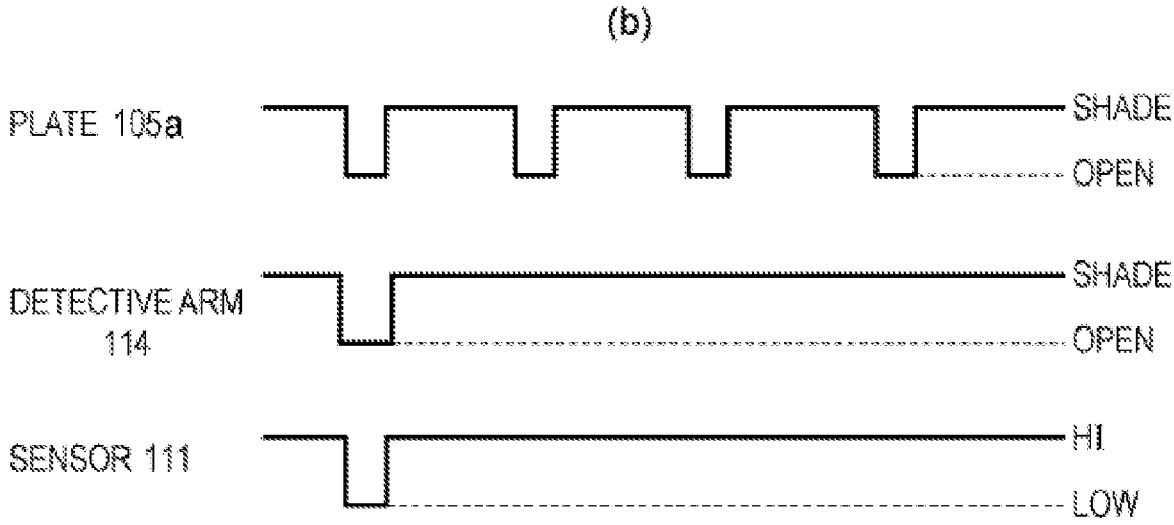
Figure 11:
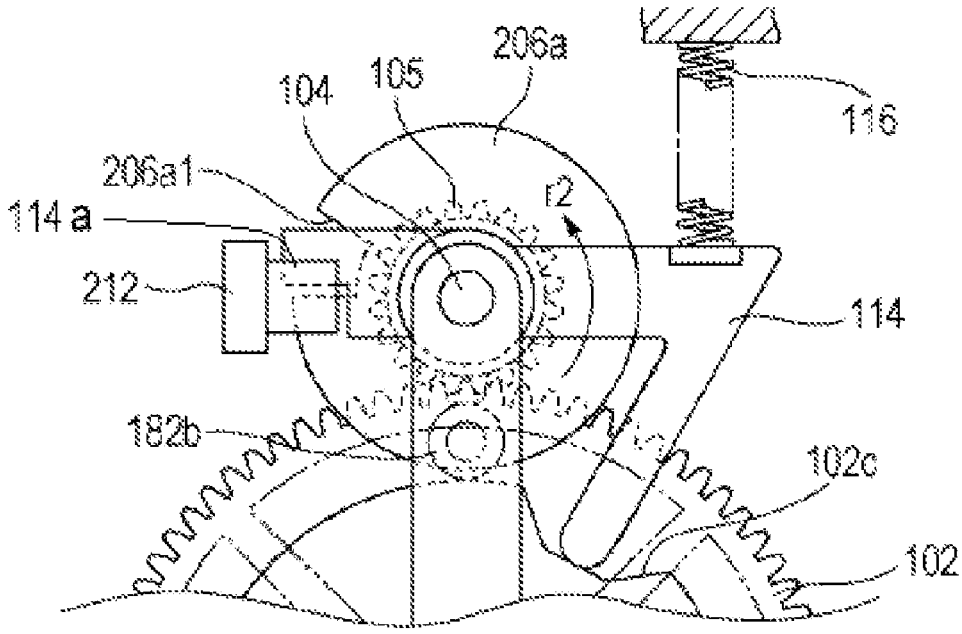
FIGS. 11A and 11B is a detail view of a sensor concerning the second embodiment.
Figure 11:
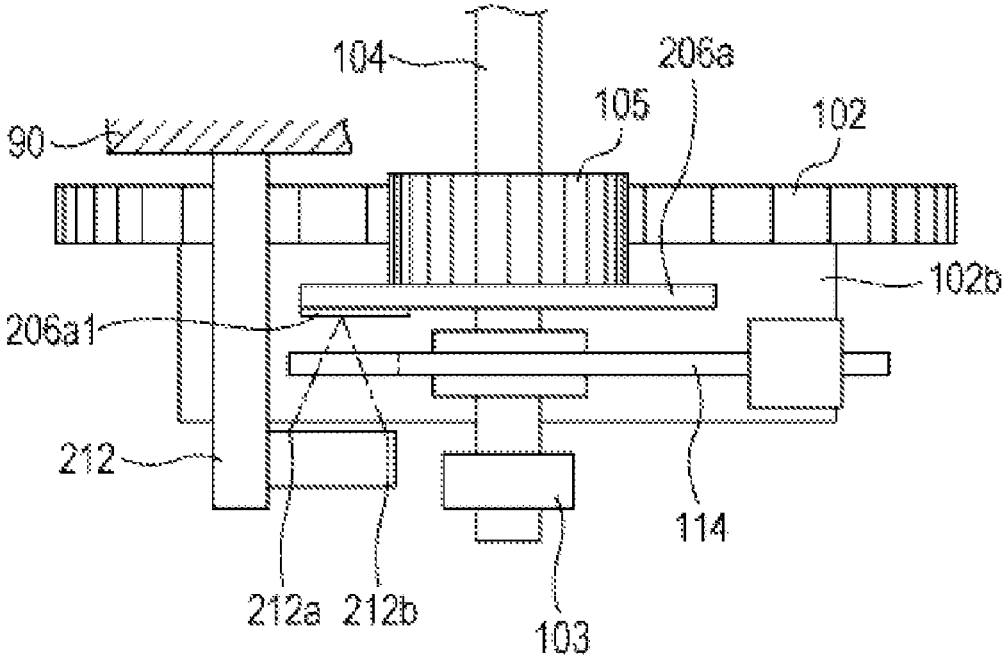

Thus, in embodiment 2, optical path L1 is opened only when the developing roller 182*a* of yellow the developing device 18*a* abuts photosensitive drum 2 as shown in FIG. 10B. Thus, the CPU 83 shown in FIG. 10A recognizes through I/O circuit 84 that voltage value of the first sensor 111 is in LOW state (e.g., 0V). When a developing device 18*b*-18*d* besides yellow the developing device 18*a* comes to the developing position 18X, the CPU 83 recognizes through I/O circuit 84 that a voltage value of the first sensor 111 is in HI state (ex. 5V) because optical path L1 is in a condition to have been shaded from the light as shown in FIGS. 11A and 11B.

The CPU 83 determines that yellow the developing roller 182*a* abuts photosensitive drum 2 when a signal of the first sensor 111 is in LOW state. Based on this information, by controlling the number of pulse output to the motor 108 by the driver 86, each developing devices 18*a*-18*d* is transported to developing position 18X and stopping at the developing position 18X is possible as shown in FIG. 10A. Each the developing roller 182*a*-182*d* is abutted to the photosensitive drum 2 and the movement to develop electroastatic latent image is performed.

Also, in the present embodiment, an example of the plate 105*a* comprising by the shading department 105*a*1 shading optical path L1 of detective light and the opening region 105*a*2 which is a notch region opening optical path L1 is mentioned. However, as well as embodiment 1, as shown in FIGS. 11A and 11B, a plate 206*a* may comprise a reflection part 206*a*1 to reflect the detective light. In this case, as for sensor 212, projection of light department 212*a* and light receiving component 212*b* of detective light is comprised on the same side like FIG. 11B. The detective light emitting light in light department 212*a* reflects when reflection part 206*a*1 comes. The detective light is received in light receiving component 212*b*. Thus, optical light L1 is opened by shading part 114*a* only when the developing roller 182*a* of yellow developing unit 18*a* abuts photosensitive drum 2. The detective light is reflected in reflection part 206*a*1 and the detective light is received in light receiving component 212*b*. The CPU 83 judges that the yellow developing roller 182*a* abuts photosensitive drum 2 when signal of the first sensor 111 is in a LOW state.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A color electrophotographic image forming apparatus for forming an image on a recording medium, the color electrophotographic image forming apparatus comprising:

a photosensitive member forming an electrostatic latent image;

a rotary support member configured to support a plurality of developing devices for developing the electrostatic latent image, and to move a developing device to a developing position for developing the electrostatic latent image by rotation;

a first member configured to rotate multiple times of a natural number when the rotary support member rotates once moving together with the rotary support member, a rotation of the first member being detected by a first sensor;

a second member configured to move with rotation of the rotary support member, the rotary support member being detected to be positioned at a predetermined phase by a second sensor, wherein the predetermined phase is a phase in a case where one of the plurality of developing devices is at the developing position; and a controlling unit configured to detect a phase of the rotary support member by a first signal to be output from the first sensor having detected the first member, and a second signal to be output from the second sensor having detected the second member.

2. The color electrophotographic image forming apparatus according to claim 1, wherein the controlling unit performs controlling such that the developing device is stopped at the developing position after detection of the phase of the rotary support member.

3. The color electrophotographic image forming apparatus according to claim 1, wherein the first member is configured such that one rotation of the first member is detected by the first sensor at the position where the developing device is at the developing position.

4. The color electrophotographic image forming apparatus according claim 1, further comprising a drive source configured to drive the rotary support member, wherein the first member rotates integrally with a first gear transmitting a drive force from the drive source to a second gear formed on a peripheral portion of the rotary support member.

5. The color electrophotographic image forming apparatus according to claim 4, wherein the first member rotates with the first gear engaging with the second gear.

6. The color electrophotographic image forming apparatus according to claim 1, wherein the first sensor includes:

a light projecting unit configured to project detective light, a light receiving unit configured to receive the detective light, and wherein the first member includes a light shading unit configured to shade a light path of the detective light and an opening unit configured to open the light path.

7. The color electrophotographic image forming apparatus according to claim 1, wherein the first sensor includes:

a light projecting unit configured to project detective light, a light receiving unit configured to receive the detective light, and wherein the first member includes a reflecting portion reflecting the detective light to the light receiving unit.

8. The color electrophotographic image forming apparatus according to claim 1, wherein the rotary support detachably a yellow developing device including a yellow developer, a magenta developing device including a magenta developer, a cyan developing device including a cyan developer, a black developing device including a black developer, and wherein the first member rotates in multiple times of 4 when moving together with the rotary support member and when the rotary support member rotates once.

9. The color electrophotographic image forming apparatus according to claim 1, wherein the predetermined phase is the phase in a case where a yellow developing device is in the developing position.

10. The color electrophotographic image forming apparatus according to claim 1, wherein d1 denotes a radius from a rotational center of the rotary support member, and wherein d2 denotes a radius from a rotational center of the first member, and wherein in a case where the first member rotates a natural n number of times when the rotary support member rotates once, a relation of $d2>d1/n$ is satisfied.

11. A color electrophotographic image forming apparatus for forming an image on a recording medium, the color electrophotographic image forming apparatus comprising:

a photosensitive member for forming an electrostatic latent image;

a rotary support member configured to support a plurality of developing devices for developing the electrostatic latent image, and to move a developing device to a developing position for developing the electrostatic latent image by rotation;

a sensor comprising a light projecting unit configured to project detective light and a light receiving unit configured to receive the detective light;

a first member configured to rotate multiple times of a natural number of times when moving together with the rotary support member and when the rotary support member rotates once, a rotation of the first member being detected by the sensor;

a second member configured to move together with the rotary support member, to open a light path of the sensor when the rotary support member is at a position of a predetermined phase, and to shield the light path when the rotary support member is at a position other than the predetermined phase; and a controlling unit configured to detect a phase of the rotary support member by a signal output from the sensor having detected the first member when the light path is opened by the second member.

12. The color electrophotographic image forming apparatus according to claim 11, wherein the controlling unit controls to stop the developing device at the developing position after detection of a phase of the rotary support member is performed.

13. The color electrophotographic image forming apparatus according to claim 11, wherein the rotation of the first member is detected by the sensor at the position where the developing device supported by the rotary support member is at the developing position.

14. The color electrophotographic image forming apparatus according to claim 11, further comprising a drive source configured to drive the rotary support member, wherein the first member rotates integrally with a first gear transmitting drive force from the drive source to a second gear formed on a peripheral portion of the rotary support member.

15. The color electrophotographic image forming apparatus according to claim 14, wherein the first member rotates with the first gear engaging with the second gear.

16. The color electrophotographic image forming apparatus according to claim 11, wherein the first member includes a light shading unit configured to shade a light path of the detective light and an opening unit configured to open the light path.

17. The color electrophotographic image forming apparatus according to claim 11, wherein the first member includes a reflecting portion reflecting the detective light to the receiving unit.

18. The color electrophotographic image forming apparatus according to claim 11, wherein the rotary support member supports detachably a yellow developing device including a yellow developer, a magenta developing device including a magenta developer, a cyan developing device including a cyan developer, a black developing device including a black developer, and wherein the first member rotates only multiple times of 4 when the rotary support member rotates once when moving together with the rotary support member.

19. The color electrophotographic image forming apparatus according to claim 11, wherein the predetermined phase is a phase in a case where one of the plurality of developing devices is at the developing position.

20. The color electrophotographic image forming apparatus according to claim 19, wherein the predetermined phase is the phase in a case where the yellow developing device is in the developing position.

21. The color electrophotographic image forming apparatus according to claim 11, wherein d1 denotes a radius from a rotational center of the rotary support member, and wherein d2 denotes a radius from a rotational center of the first member, and wherein in a case where the first member rotates a natural n number of times when the rotary support member rotates once, a relation of $$d2>d1/n$$

is satisfied.

22. A color electrophotographic image forming apparatus for forming an image on a recording medium, the color electrophotographic image forming apparatus comprising:

a photosensitive member for forming an electrostatic latent image;

a rotary support member configured to support a plurality of developing devices for developing the electrostatic latent image, and to move a developing device to a developing position for developing the electrostatic latent image by rotation;

a first member configured to rotate multiple times of a natural number of times when moving together with the rotary support member and when the rotary support member rotates once, a rotation of the first member being detected by a sensor;

a second member configured to move with rotation of the rotary support member, to allow the sensor to detect the first member when the rotary support member is at a position of a predetermined phase, and not to allow the sensor to detect the first member when the rotary support member is at a position other than the predetermined phase; and a controlling unit configured to detect a phase of the rotary support member by a signal output from the sensor having detected the first member when the second member allows the sensor to detect the first member.

23. The color electophotographic image forming apparatus according to claim 22, wherein the controlling unit controls to stop the developing device at the developing position after detection of a phase of the rotary support member is performed.

24. The color electrophotographic image forming apparatus according to claim 22, wherein the rotation of the first member is detected by the sensor at the position where the developing device supported by the rotary support member is at the developing position.

25. The color electophotographic image forming apparatus according to claim 22, further comprising a drive source configured to drive the rotary support member, wherein the first member rotates integrally with a first gear transmitting drive force from the drive source to second gear formed on a peripheral portion of the rotary support member.

26. The color electrophotographic image forming apparatus according to claim 25, wherein the first member rotates with the first gear engaging with the second gear.

27. The color electrophotographic image forming apparatus according to claim 22, wherein the rotary support member supports detachably a yellow developing device including a yellow developer, a magenta developing device including a magneta developer, a cyan developing device including a cyan developer, a black developing device including a black developer, and wherein the first member rotates only multiple times of 4 when the rotary support member rotates once when moving together with the rotary support member.

28. The color electrophotographic image forming apparatus according to claim 22, wherein the predetermined phase is a phase in a case where one of the plurality of developing devices is at the developing position.

29. The color electrophotographic image forming apparatus according to claim 28, wherein the predetermined phase is the phase in a case where a yellow developing is in the developing position.

30. The color electrophotographic image forming apparatus according to claim 22, wherein d1 denotes a radius from a rotational center of the rotary support member, and wherein d2 denotes a radius from a rotational center of the first member, and wherein in a case where the first member rotates a natural n number of times when the rotary support member rotates once, a relation of $d2>d1/n$ is satisfied.

* * * * *